US008169452B2

(12) United States Patent
Morooka et al.

(10) Patent No.: US 8,169,452 B2
(45) Date of Patent: May 1, 2012

(54) THERMAL HEAD AND PRINTER

(75) Inventors: Toshimitsu Morooka, Chiba (JP); Keitaro Koroishi, Chiba (JP); Yoshinori Sato, Chiba (JP); Noriyoshi Shoji, Chiba (JP); Norimitsu Sanbongi, Chiba (JP)

(73) Assignee: Seiko Instruments Inc. (JP)

( * ) Notice: Subject to any disclaimer, the term of this patent is extended or adjusted under 35 U.S.C. 154(b) by 268 days.

(21) Appl. No.: 12/586,990

(22) Filed: Sep. 30, 2009

(65) Prior Publication Data

US 2011/0074902 A1 Mar. 31, 2011

(30) Foreign Application Priority Data

Oct. 3, 2008 (JP) ..... 2008-258696

(51) Int. Cl.
*B41J 2/335* (2006.01)

(52) U.S. Cl. ..... 347/206; 347/200

(58) Field of Classification Search ..... 347/200, 347/201, 204, 205, 206
See application file for complete search history.

(56) References Cited

U.S. PATENT DOCUMENTS 5,285,216 A 2/1994 Ota et al. ..... 347/223

FOREIGN PATENT DOCUMENTS

| | | |
|---|---|---|
| DE | 3435407 | 4/1986 |
| EP | 0763431 | 3/1997 |
| JP | 2007 83532 | 4/2007 |

*Primary Examiner* — Kristal Feggins
(74) *Attorney, Agent, or Firm* — Adams & Wilks

(57) ABSTRACT

A thermal head has a heat storage layer bonded onto a surface of the substrate, a heating resistor provided on the heat storage layer, and a pair of electrode portions connected to the heating resistor. The heating resistor has a heating portion which does not overlap the pair of electrode portions. A hollow portion is provided in a region of at least one of the surface of the substrate and a surface of the heat storage layer, the region being opposed to the heating resistor. A center line of the hollow portion is shifted with respect to a center line of a heating portion of the heating resistor.

20 Claims, 9 Drawing Sheets

THERMAL HEAD AND PRINTER

BACKGROUND OF THE INVENTION

1. Field of the Invention

The present invention relates to a thermal head and a printer.

2. Description of the Related Art

There have been conventionally known a thermal head which is used in a thermal printer often mounted to a portable information equipment terminal typified by a compact hand-held terminal, and which is used to perform printing on a thermal recording medium based on printing data with the aid of selective driving of a plurality of heating elements (for example, see JP 06-166197 A).

In terms of an increase in efficiency of the thermal head, there is a method of forming a heat insulating layer below a heating portion of a heating resistor. By formation of the heat insulating layer below the heating portion, of an amount of heat generated in the heating resistor, an amount of upper-transferred heat which is transferred to an abrasion resistance layer formed above the heating portion becomes larger than an amount of lower-transferred heat which is transferred to a heat storage layer formed below the heating portion, and hence energy efficiency required during printing can be sufficiently obtained. In the thermal head described in JP 06-166197 A, a hollow portion is provided in a layer below the heating portion of the heating resistor, and this hollow portion functions as a hollow heat insulating layer. Thus, the amount of upper-transferred heat becomes larger than the amount of lower-transferred heat, and the energy efficiency is increased.

Further, in a printer in which a thermal head is installed, thermal paper is pressed, with a predetermined pressing force, against a head portion of a surface of the abrasion resistance layer formed above the heating portion. Therefore, the thermal head is required to have heat generation efficiency for improving printing quality as described above, and required to have strength for withstanding the pressing force of the platen roller.

However, in the hollow heat insulating layer of the thermal head described in Patent Document 1, a center position of the hollow portion substantially corresponds to a center position of the heat generating portion, the hollow heat insulating layer having a size with which the heat generating portion is contained in a region of the hollow portion. Therefore, when an external load is applied to the heat generating portion, deflection at a central portion of the heat storage layer becomes large. Particularly, there is a risk that deflection of the heat storage layer becomes excessive in the case of a sheet jam or the like, whereby the heat storage layer is broken. Further, there is a risk that, when a pressing force of the platen roller causes the heat storage layer to be deflected, a contact state between the thermal paper and the head portion is deteriorated so as to decrease a contact pressure, and it becomes difficult to be transfer heat to the thermal paper.

SUMMARY OF THE INVENTION

The present invention has been made in view of the above-mentioned circumstances, and an object of the present invention is therefore to provide a thermal head and a printer in which improvements in heat generation efficiency and strength against an external load are achieved.

In order to achieve the above-mentioned object, the present invention provides the following techniques.

The present invention provides a thermal head comprising: a substrate; a heat storage layer bonded onto a surface of the substrate; and a heating resistor provided on the heat storage layer, wherein: a concave portion is provided in a region, which is opposed to the heating resistor, of at least one of the surface of the substrate and a surface on a side of the substrate of the heat accumulating portion; and a center line of a hollow portion formed, by the concave portion, between the substrate and the heat storage layer is shifted with respect to a center line of the heating resistor.

According to the present invention, by causing the hollow portion to function as the hollow heat insulating layer, it is possible to inhibit the heat generated by the heating resistors from being transferred to the substrate through an intermediation of the heat storage layer. As a result, an amount of heat conducted above the heating resistors to be used for printing and the like is increased, whereby improvement in heat generation efficiency can be achieved.

A central axis of a platen roller pressing an object to be printed, such as thermal paper, against the heating resistors is caused to correspond substantially to the center line of the heating resistor, and hence the largest load is applied on the center line of the heating resistor. According to the present invention, the center line of the hollow portion is shifted with respect to the center line of the heating resistor, and hence the external load applied to the heat storage layer covering the hollow portion acts on a position shifted with respect to the center line of the hollow portion. That is, the external load acts on a position near any one of edges of the hollow portion, and hence the deflection amount of the heat storage layer supporting the heating resistors can be reduced in comparison with a case where the external load acts on the center line of the hollow portion. As a result, a strength against the external load can be improved.

The present invention provides a printer comprising: the above-mentioned thermal head of the present invention; and a pressure mechanism for feeding out an object to be printed while pressing the object to be printed against the heating resistor of the thermal head.

According to the present invention, because of high heat-generation efficiency of the thermal head, electrical power consumption at the time of printing onto a printed material can be reduced. Further, because of the small deflection amount of the heat storage layer with respect to the pressing force of the pressure mechanism, it is possible to reliably bring the heating resistors into contact with the object to be printed so as to transfer heat. Accordingly, it is possible to perform printing of excellent printing quality with a little electrical power.

In the above-mentioned aspect of the present invention, due to a relationship with a feeding direction of the object to be printed which is fed by the pressure mechanism, the center line of the hollow portion of the thermal head may be positioned forward in the feeding direction with respect to the center line of the heating resistor, and an end portion positioned rearward in the feeding direction of the hollow portion may be arranged in a region opposed to the heating resistor.

With the above-mentioned structure, the heat storage layer above the hollow portion, which supports the heating resistors, is more likely to be deflected, upon receiving the load applied by the pressure mechanism substantially to the center of the heating resistor, at a further forward position in the feeding direction with respect to the center line of the heating resistor. Therefore, a contact pressure between the object to be printed and the heating resistors becomes small, and hence trailing after turning off the electrical power of the printer can be inhibited. Note that, "trailing" refers to a phenomenon in which, due to remaining heat of the thermal head after turning off the electrical power of the printer, printing is performed on a portion following a region on which printing is to be performed though a printing instruction is not given in printing data.

Further, in the above-mentioned aspect of the present invention, due to a relationship with a feeding direction of the object to be printed by the pressure mechanism, the center line of the hollow portion of the thermal head may be positioned rearward in the feeding direction with respect to the center line of the heating resistor, and an end portion positioned forward in the feeding direction of the hollow portion may be arranged in a region opposed to the heating resistor.

By the foregoing construction, the heat storage layer above the hollow portion, which supports the heating resistors, is less likely to be deflected, upon receiving the load applied by the pressure mechanism substantially to the center of the heating resistor, at a further forward position in the feeding direction with respect to the center line of the heating resistor. For example, when the object to be printed is fed out by rotation of the pressure mechanism, such as the platen roller, the load applied to the heating resistors moves forward in the feeding direction with respect to the center. According to the present invention, it is possible to reduce the deflection of the heat storage layer with respect to the load applied to the heating resistors forward in the feeding direction.

According to the present invention, it is possible to provide an effect that improvements in heat generation efficiency and strength against the external load can be achieved.

DETAILED DESCRIPTION OF THE PREFERRED EMBODIMENT

Hereinafter, a thermal head 1 and a thermal printer (printer) 10 according to an embodiment of the present invention are described with reference to drawings.

Figure 1:
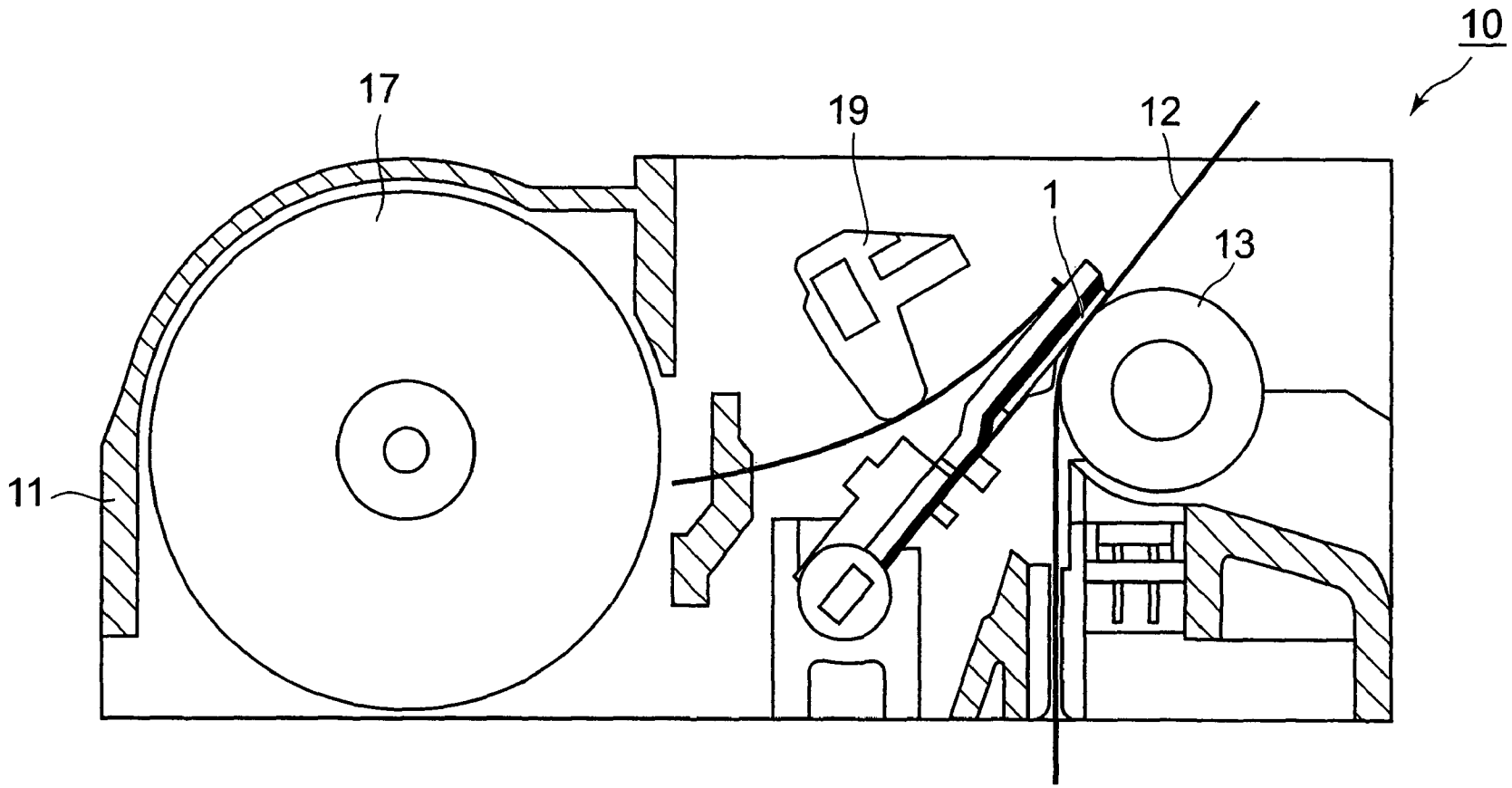
FIG. 1 is a schematic structural view of a thermal printer according to an embodiment of the present invention.

The thermal printer 10 according to this embodiment includes: as illustrated in FIG. 1, a main body frame 11; a platen roller 13 arranged horizontally; a thermal head 1 arranged oppositely to an outer peripheral surface of the platen roller 13; a heat dissipation plate 15 (see FIG. 3) supporting the thermal head 1; a paper feeding mechanism 17 for feeding between the platen roller 13 and the thermal head 1 an object to be printed, such as thermal paper (paper medium) 12; and a pressure mechanism 19 for pressing the thermal head 1 against the thermal paper 12 with a predetermined pressing force.

Against the platen roller 13, the thermal head 1 and the thermal paper 12 are pressed by the operation of the pressure mechanism 19. By this construction, load of the platen roller 13 is applied to the thermal head 1 through an intermediation of the thermal paper 12.

The heat dissipation plate 15 is a plate-shaped member made of a resin, ceramics, glass, a metal such as aluminum, or the like, and serves for fixation and heat dissipation of the thermal head 1.

Figure 2:
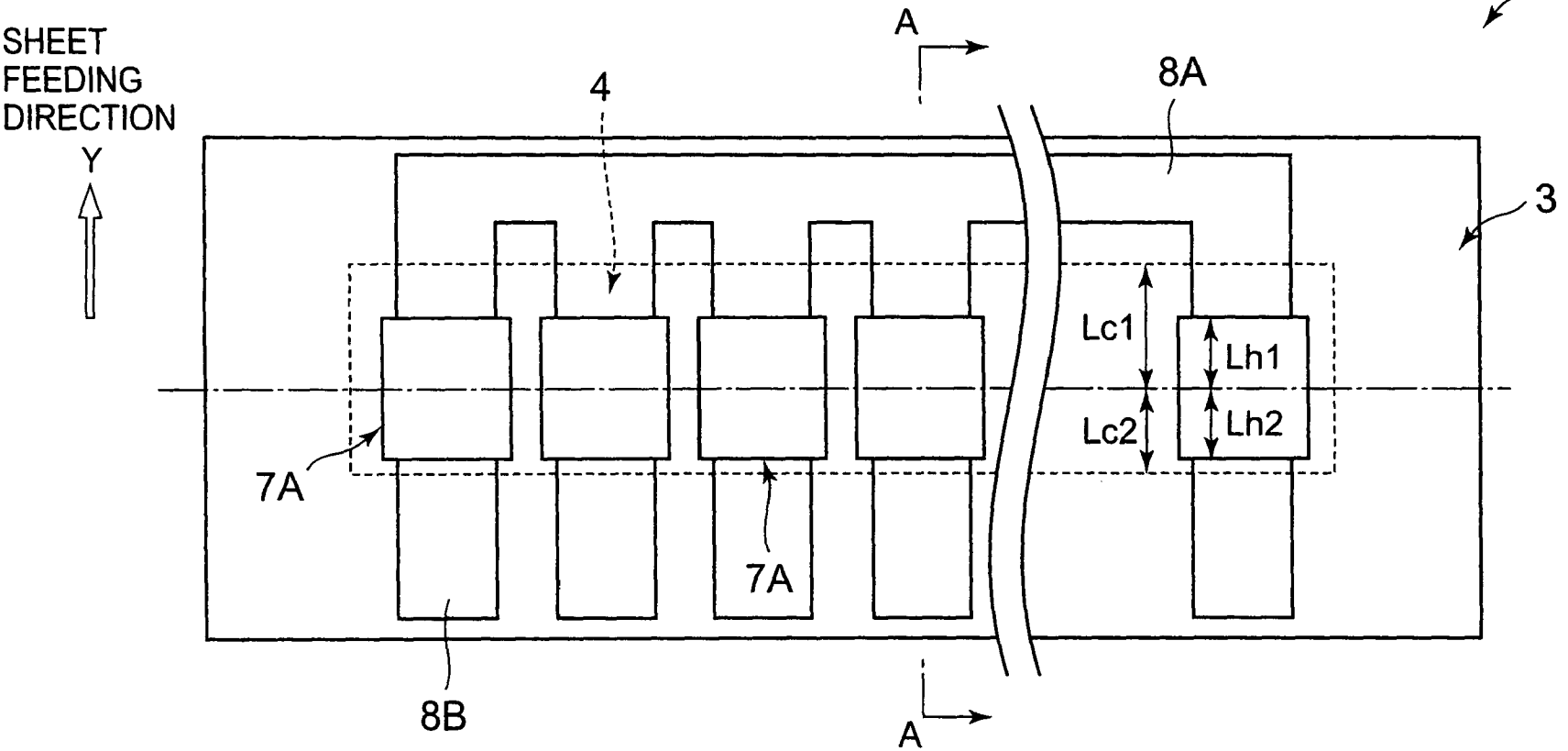
FIG. 2 is a plane view of the thermal head of FIG. 1 when seen from a protective film side.
Figure 3:
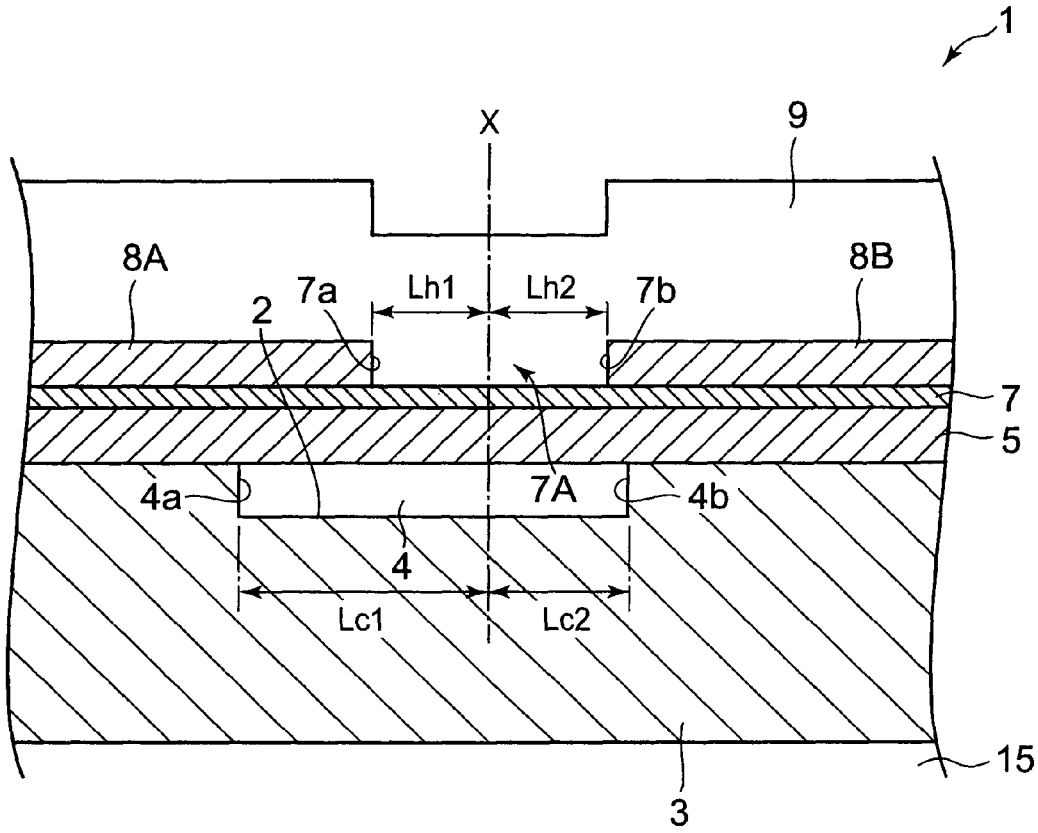
FIG. 3 is a sectional view of the thermal head of FIG. 2 taken along the arrows A-A.
Figure 4A:
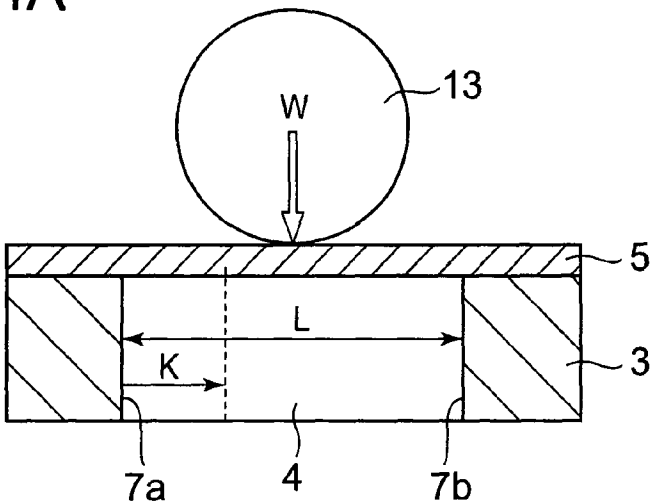
FIG. 4A is a vertical sectional view illustrating a state in which load of a platen roller is applied to a center of a heat storage layer.
Figure 4B:
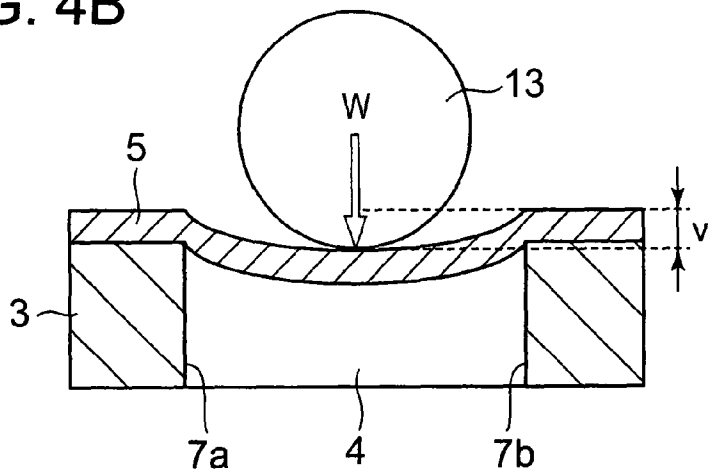
FIG. 4B is a vertical sectional view illustrating a state in which the heat storage layer is deflected in the case of Part (a)
Figure 4C:
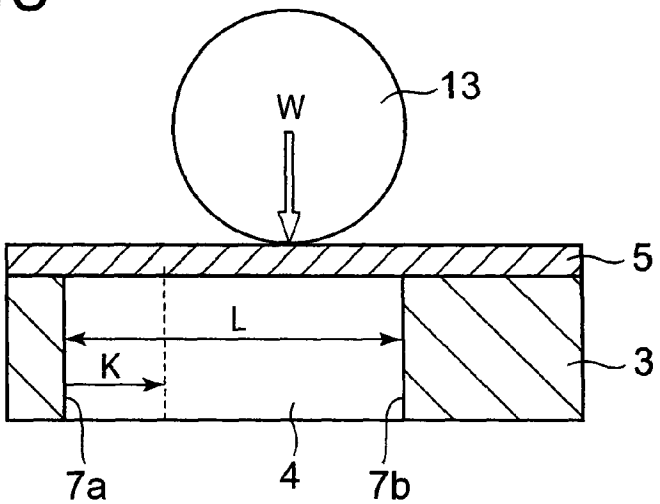
FIG. 4C is a vertical sectional view illustrating a state in which the load of the platen roller acts on a position shifted from the center of the heat storage layer.
Figure 4D:
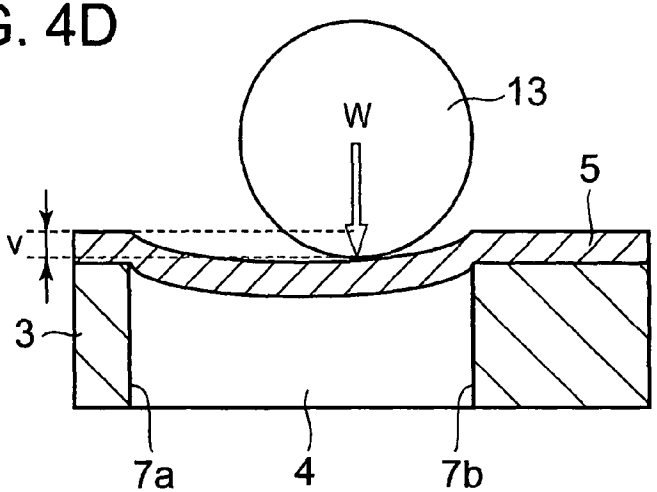
FIG. 4D is a vertical sectional view illustrating a state in which the heat storage layer is deflected in the case of FIG. 4C.

The thermal head 1 has a plate shape as illustrated in FIG. 2. As illustrated in FIG. 3 (which is a sectional view taken along the arrow A-A of FIG. 2), the thermal head 1 includes: a rectangular supporting substrate (supporting plate) 3 fixed on the heat dissipation plate 15; a heat storage layer 5 bonded onto the surface of the supporting substrate 3; a plurality of heating resistors 7 provided on the heat storage layer 5; electrode portions 8A, 8B connected to the heating resistors 7; and a protective film 9 covering the heating resistors 7 and the electrode portions 8A, 8B so as to protect the same from abrasion and corrosion. The arrow Y in FIG. 2 denotes a feeding direction of the thermal paper 12 by the paper feeding mechanism 17.

The supporting substrate 3 is an insulative substrate such as a glass substrate and a silicon substrate. In a surface on the heat storage layer 5 side of the supporting substrate 3, there is formed a rectangular concave portion 2 extending in a longitudinal direction.

The heat storage layer 5 is constituted by a thin plate glass having a thickness of approximately 10 to 50 μm. In the case where the supporting substrate 3 is a glass substrate, thermal fusion bonding is used for boning the heat storage layer 5 and the supporting substrate 3 together. Further, when the supporting substrate 3 is a silicon substrate, anodic bonding is used.

Between the supporting substrate 3 and the heat storage layer 5, a hollow portion 4 is formed by covering the concave portion 2 of the supporting substrate 3 with the heat storage layer 5 (Hereinafter, hollow portion is referred to as "hollow heat insulating layer."). The hollow heat insulating layer 4 functions as an insulating layer for inhibiting a heat inflow from the heat storage layer 5 to the supporting substrate 3, and has a communicating structure opposed to all the heating resistors 7. By causing the hollow portion to function as the heat insulating layer, it is possible to inhibit the heat generated by the heating resistors 7 from being transmitted through an intermediation of the heat storage layer 5 to the supporting substrate 3. As a result, an amount of heat conducted above the heating resistors 7 to be used for printing and the like is increased, whereby improvement in heat generation efficiency is achieved.

The heating resistors 7 are each provided so as to straddle the hollow concave portion 2 in its width direction on an upper end surface of the heat storage layer 5, and are arranged at predetermined intervals in the longitudinal direction of the hollow concave portion 2. In other words, each of the heating resistors 7 is provided to be opposed to the hollow heat insulating layer 4 while sandwiching the heat storage layer 5, and is arranged so as to be situated above the hollow heat insulating layer 4.

The electrode portions 8A, 8B serve to heat the heating resistors 7, and are constituted by a common electrode 8A connected to one end of each of the heating resistors 7 in a direction orthogonal to the arrangement direction of the heating resistors 7, and individual electrodes 8B connected to the other end of each of the heating resistors 7. The common electrode 8A is integrally connected to all the heating resistors 7.

When voltage is selectively applied to the individual electrodes 8B, current flows through the heating resistors 7 connected to the selected individual electrodes 8B and the common electrode 8A opposed thereto, whereby the heating resistors 7 are heated. In this state, the thermal paper 12 is pressed by the operation of the pressure mechanism 19 against the surface portion (printing portion) of the protective film 9 covering the heating portions of the heating resistors 7, whereby color is developed on the thermal paper 12 and printing is performed.

It is noted that of each of the heating resistors 7, an actually heating portion is a portion of each of the heating resistors 7 on which the electrode portions 8A, 8B do not overlap, that is, a portion of each of the heating resistors 7 which is a region between the connecting surface of the common electrode 8A and the connecting surface of each of the individual electrodes 8B and is situated substantially directly above the hollow heat insulating layer 4 (Hereinafter, heating portion is referred to as "heating portion 7A.").

In the thermal head 1 according to this embodiment, when seen from the protective film 9 side, a region of the hollow heat insulating layer 4 is larger than a region of the opposed heat generating portion 7A, and the heat generating portion 7A is arranged within the region of the hollow heat insulating layer 4. Further, the hollow heat insulating layer 4 is arranged, with a center line thereof being shifted with respect to a center line X of the heating resistor 7, that is, with respect to the center line X of the heat generating portion 7A.

Specifically, the center line of the hollow heat insulating layer 4 is positioned forward in the feeding direction Y of the thermal paper 12 with respect to the center line X of the heat generating portion 7A. It is noted that the center line of the hollow heat insulating layer 4 and the center line X of the heat generating portion 7A represent a line, as seen from the protective film 9 side, passing a center position of the surface of the heat generating portion 7A or a center position of the surface of the hollow heat insulating layer 4, and being parallel to a direction orthogonal to the feeding direction Y of the thermal paper 12 (longitudinal direction of the supporting substrate 3).

In the following description, with reference to center line X of the heat generating portion 7A, a distance from the center line X to an end portion positioned forward in the thermal paper feeding direction Y (hereinafter, referred to as "forward end portion") of the heat generating portion 7A is denoted by Lh1, and a distance from the center line X to an end portion positioned rearward in the thermal paper feeding direction Y (hereinafter, referred to as "rearward end portion") of the heat generating portion 7A is denoted by Lh2. In the heat generating portion 7A, a relationship of Lh1=Lh2 is established. Further, a distance from the center line X of the heat generating portion 7A to an end portion positioned forward in the thermal paper feeding direction Y (hereinafter, referred to as "forward end portion") of the hollow heat insulating layer 4 is denoted by Lc1, and a distance from the center line X to an end portion positioned rearward in the thermal paper feeding direction Y (hereinafter, referred to as "rearward end portion") of the hollow heat insulating layer 4 is denoted by Lc2. In the hollow heat insulating layer 4 and the heat generating portion 7A, relationships of Lc1>Lc2, Lc1>Lh2, and Lc2>Lh2 are established.

In the following description, with reference to FIGS. 4A-4D, a relationship is described between a load of the platen roller 13 acting on the thermal head 1 and a deflection of the heat storage layer 5 in the thermal printer 10 structured as described above.

The relationship between the load W of the platen roller 13 and the deflection v of the heat storage layer 5 is represented as follows:

$$v=(W/48EI)\times K(3L^2-4K^2) \quad \text{(Formula 1)}$$

In (Formula 1), L represents a length of the hollow heat insulating layer 4 in the thermal paper feeding direction, K represents a distance from the forward end portion 7*a* of the hollow heat insulating layer 4, E represents a Young's modulus of a material of the heat storage layer 5, and I represents a second moment of area (amount depending on a sectional shape) of the heat storage layer 5.

Further, when (Formula 2) x=L/2 is established, a deflection amount of the heat storage layer 5 is a maximum. That is, the deflection amount is at a maximum when the external load is applied to the center of the heat storage layer 5. It is noted that in FIGS. 4A-4D, the heating resistor 7 and the protective film 9 are omitted.

A central axis of the platen roller 13 is caused to correspond substantially to the center line X of the heating resistor 7 (center line 7A of heat generating portion 7A), and hence the largest external load is applied on the center line X of the heat generating portion 7A. The center line of the hollow heat insulating layer 4 is shifted with respect to the center line X of the heat generating portion 7A, and hence the external load applied to the heat storage layer 5 covering the hollow heat insulating layer 4 acts on a position shifted with respect to the center line of the hollow heat insulating layer 4.

That is, the external load of the platen roller 13 acts on a position near an edge of the hollow heat insulating layer 4, specifically, a rearward position in the thermal paper feeding direction Y of the hollow heat insulating layer 4. Therefore, the deflection amount of the heat storage layer 5 supporting the heating resistors 7 can be reduced in comparison with a case where the external load acts on the center line of the hollow heat insulating layer 4. As a result, strength against the external load of the heat storage layer 5 can be improved. Accordingly, even when a load applied to the heat storage layer is increased due to a sheet jam or the like, it is possible to prevent breakage of the heat storage layer.

As described above, in the thermal head 1 and the thermal printer 10 according to this embodiment, the heat generating portion 7A is arranged within the region of the hollow heat insulating layer 4, to thereby make the amount of heat conducted to an upper side of the heat generating portion 7A larger than the amount of heat conducted to a lower side thereof. As a result, high heat-generation efficiency can be obtained. Further, the hollow heat insulating layer 4 is arranged with the center line thereof being shifted with respect to the center line X of the heat generating portion 7A, thereby reducing the deflection amount of the heat storage layer 5 supporting the heating resistors 7 at an upper side of the hollow heat insulating layer 4. As a result, the strength against the external load can be improved. By this construction, it is possible to achieve improvements in heat generation efficiency and strength against the external load.

Further, because of high heat-generation efficiency of the thermal head 1, electrical power consumption at the time of printing onto the thermal paper 12 can be reduced. Further, because of the small deflection amount of the heat storage layer 5 with respect to the pressing force of the platen roller 13, it is possible to reliably bring the heating resistors 7 into contact with the thermal paper 12 so as to transfer heat. Accordingly, it is possible to perform printing with excellent printing quality with reduced electrical power.

The embodiment described herein can be modified as follows.

Figure 5:
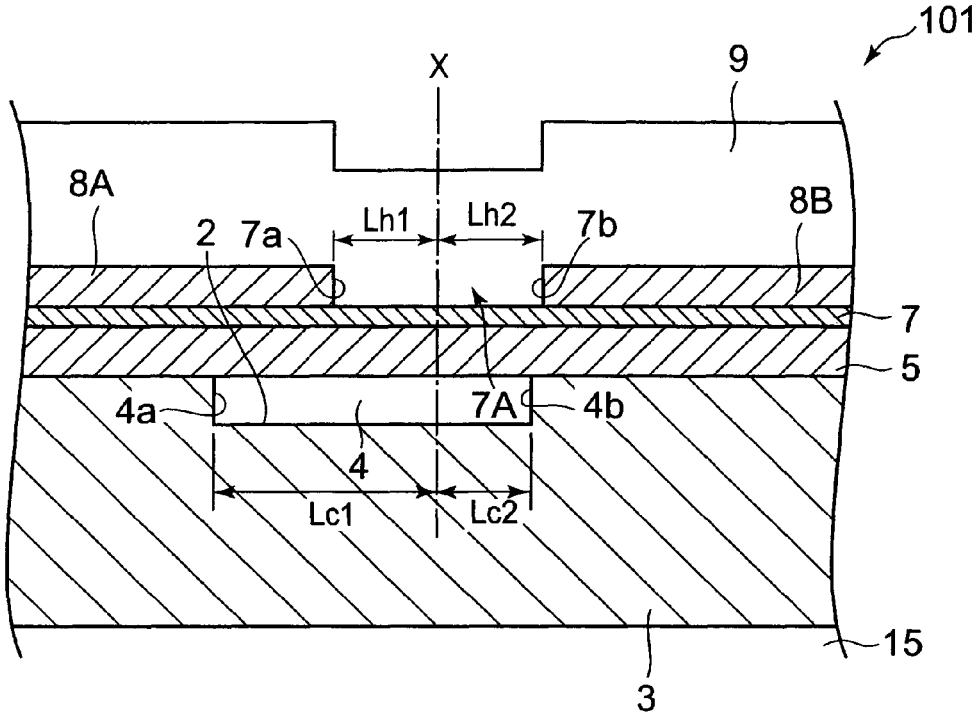
FIG. 5 is a vertical sectional view of a thermal head according to a first modification of the embodiment of the present invention.
Figure 6:
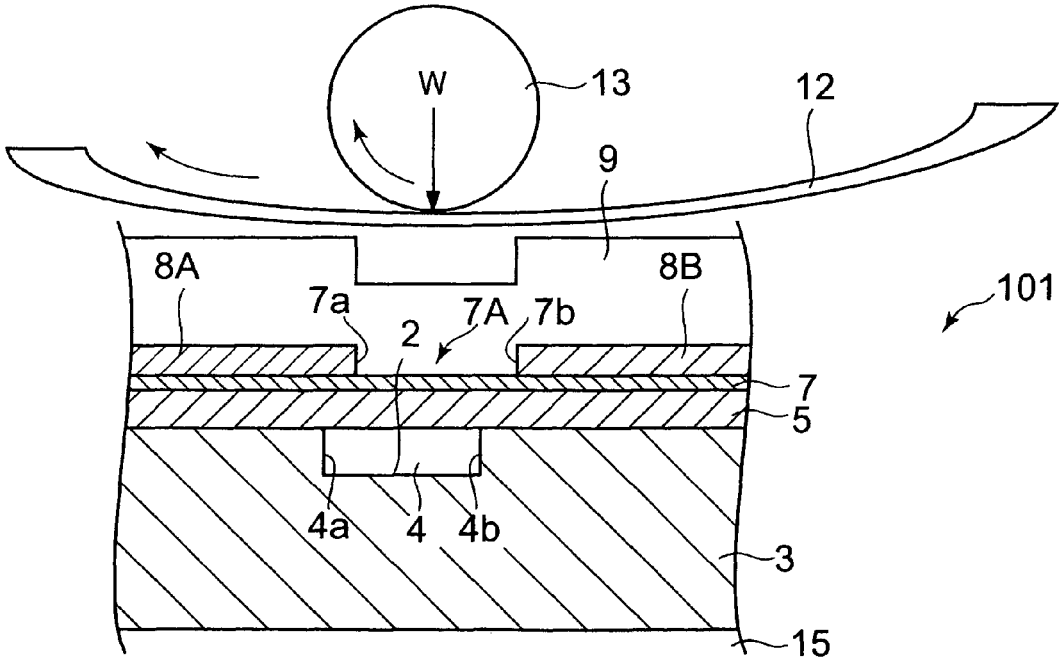
FIG. 6 is a vertical sectional view illustrating a state in which thermal paper is pressed against the thermal head of FIG. 5 by the platen roller.

For example, in this embodiment, the heat generating portion 7A is arranged within the region of the hollow heat insulating layer 4. However, as illustrated in FIGS. 5 and 6, in a thermal head 101 according to a first modification, the forward end portion 4*a* of the hollow heat insulating layer 4 may be arranged outside the region of the heat generating portion 7A, and the rearward end portion 4*b* may be arranged within the region of the heat generating portion 7A. In this case, in the hollow heat insulating layer 4 and the heat generating portion 7A, relationships of Lc1>Lc2, Lc1>Lh1, and Lc2<Lh2 are established.

The rearward end portion 7*b* of the heat generating portion 7A is directly supported by the supporting substrate 3, and the forward end portion 7*a* is supported by the hollow heat insulating layer 4. By this construction, the heat storage layer 5 above the hollow heat insulating layer 4, which supports the heat generating portion 7A, is more likely to be deflected, upon receiving the load applied by the platen roller 13 substantially to the center of the heating resistor 7, at a further forward position in the thermal paper feeding direction Y with respect to the center line X of the heat generating portion 7A. Therefore, a contact pressure between the thermal paper 12 and the heating resistors 7 becomes small, and hence trailing in the thermal printer 10 after turning off the electrical power can be inhibited.

Figure 7:
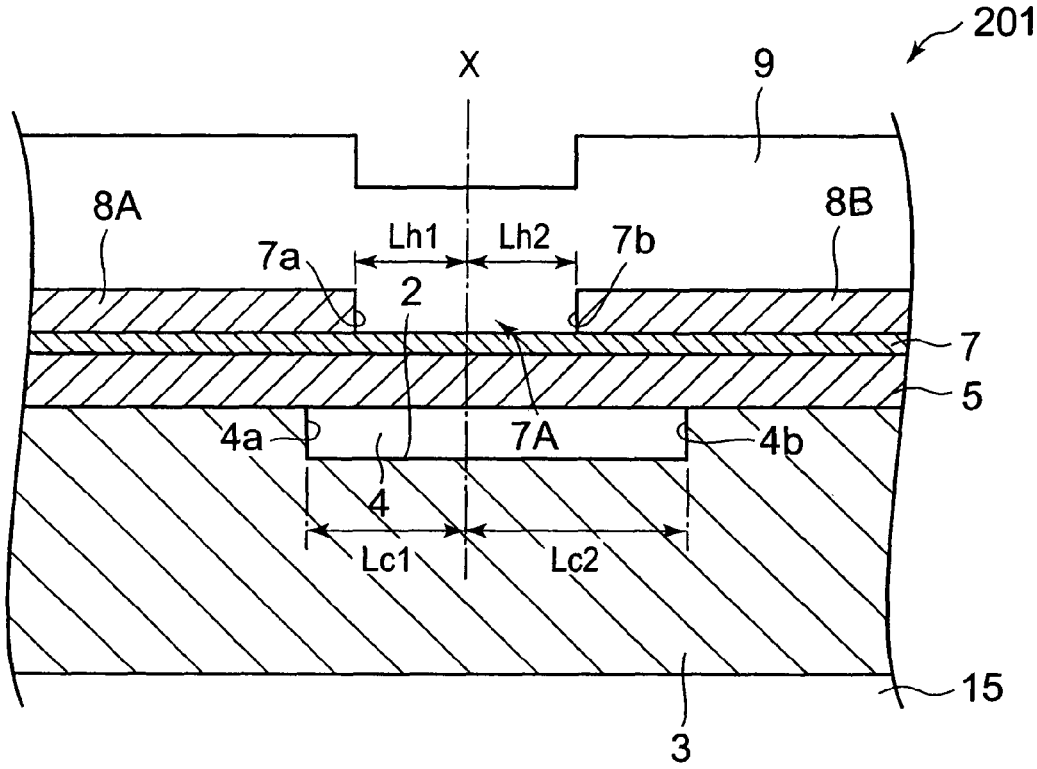
FIG. 7 is a vertical sectional view of a thermal head according to a second modification of the embodiment of the present invention.

Further, in a thermal head 201 according to a second modification, as illustrated in FIG. 7, the center line of the hollow heat insulating layer 4 may be positioned rearward in the thermal paper feeding direction Y with respect to the center line X of the heat generating portion 7A, and the heat generating portion 7A may be arranged within the region of the hollow heat insulating layer 4. In this case, in the hollow heat insulating layer 4 and the heat generating portion 7A, relationships of Lc1<Lc2, Lc1>Lh1, and Lc2>Lh2 are established.

During printing, the thermal paper 12 moves in the feeding direction Y by rotation of the platen roller 13, whereby the load of the platen roller 13 in some cases moves forward in the thermal paper feeding direction Y with respect to the center line X of the heat generating portion 7A. For example, there is a tendency that the external load is applied to a vicinity of a substantial center of the heat generating portion 7A when a moving speed of the thermal paper 12 is low, and the large external load is applied forward in the thermal paper feeding direction Y with respect to the center line X of the heat generating portion 7A when the moving speed of the thermal paper 12 is high. By reducing the region of the hollow heat insulating layer 4, which supports the forward end portion 7*a* side of the heat generating portion 7A, it is possible to effectively reduce, regardless of the moving speed of the thermal paper 12, the deflection amount of the heat storage layer 5 in a region in which the load of the platen roller 13 is applied, to thereby further improve the strength against the external load.

Figure 8:
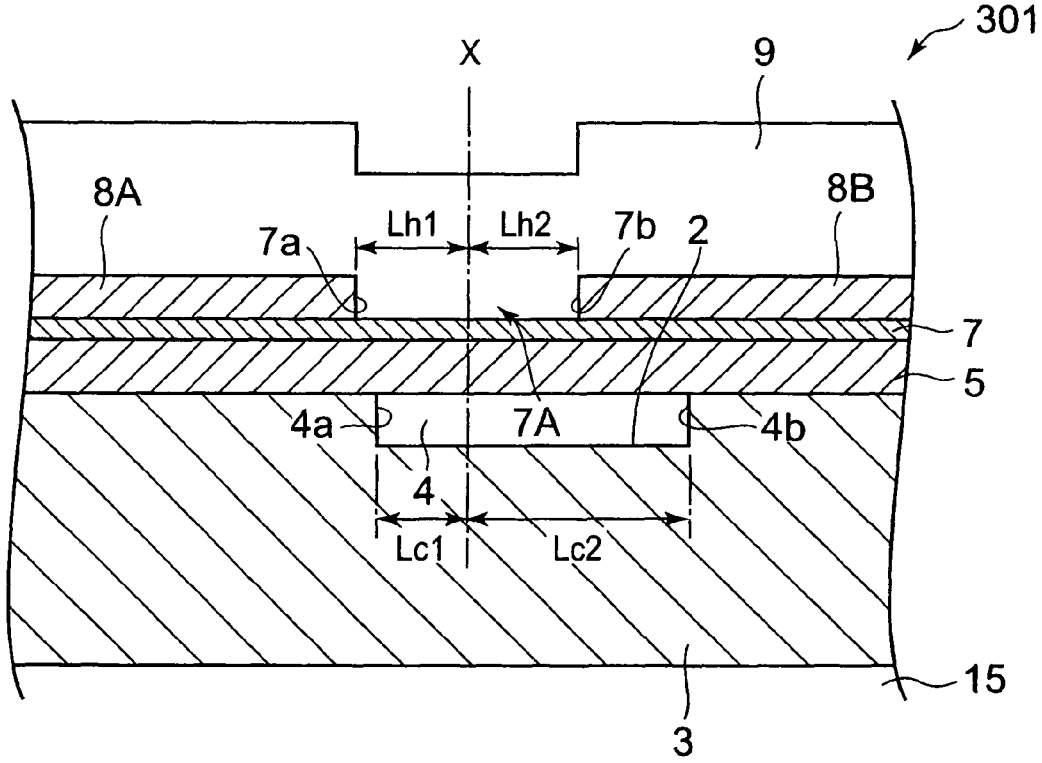
FIG. 8 is a vertical sectional view of a thermal head according to a third modification of the embodiment of the present invention.

Further, in a thermal head 301 according to a third modification, as illustrated in FIG. 8, the center line of the hollow heat insulating layer 4 may be positioned rearward in the thermal paper feeding direction Y with respect to the center line X of the heat generating portion 7A, the forward end portion 4*a* of the hollow heat insulating layer 4 may arranged within the region of the heat generating portion 7A, and the rearward end portion 4*b* may be arranged outside the region of the heat generating portion 7A. In this case, in the hollow heat insulating layer 4 and the heat generating portion 7A, relationships of Lc1<Lc2, Lc1<Lh1, and Lc2>Lh2 are established.

Figure 9:
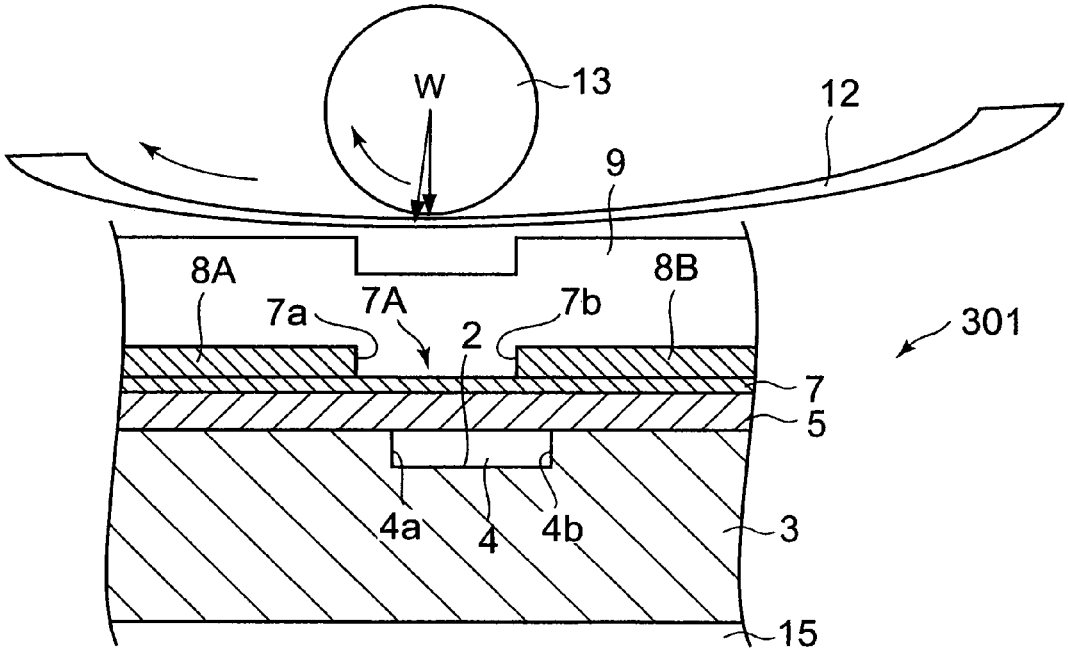
FIG. 9 is a vertical sectional view illustrating a state in which the thermal paper is pressed against the thermal head of FIG. 8 by the platen roller.

The forward end portion 7*a* of the heat generating portion 7A is directly supported by the supporting substrate 3, and the rearward end portion 7*a* is supported by the hollow heat insulating layer 4. By this construction, the heat storage layer 5 above the hollow heat insulating layer 4, which supports the heat generating portion 7A, is less likely to be deflected, upon receiving the load applied by the platen roller 13 substantially to the center of the heating resistor 7, at a further forward position in the thermal paper feeding direction Y with respect to the center line X of the heat generating portion 7A. Therefore, as illustrated in FIG. 9, with respect to the load applied, when the rotation of the platen roller 13 feeds the thermal paper 12 forwardly in the thermal paper feeding direction Y with respect to the center of the heating resistor 7, the deflection of the heat storage layer 5 can be reduced.

Figure 10:
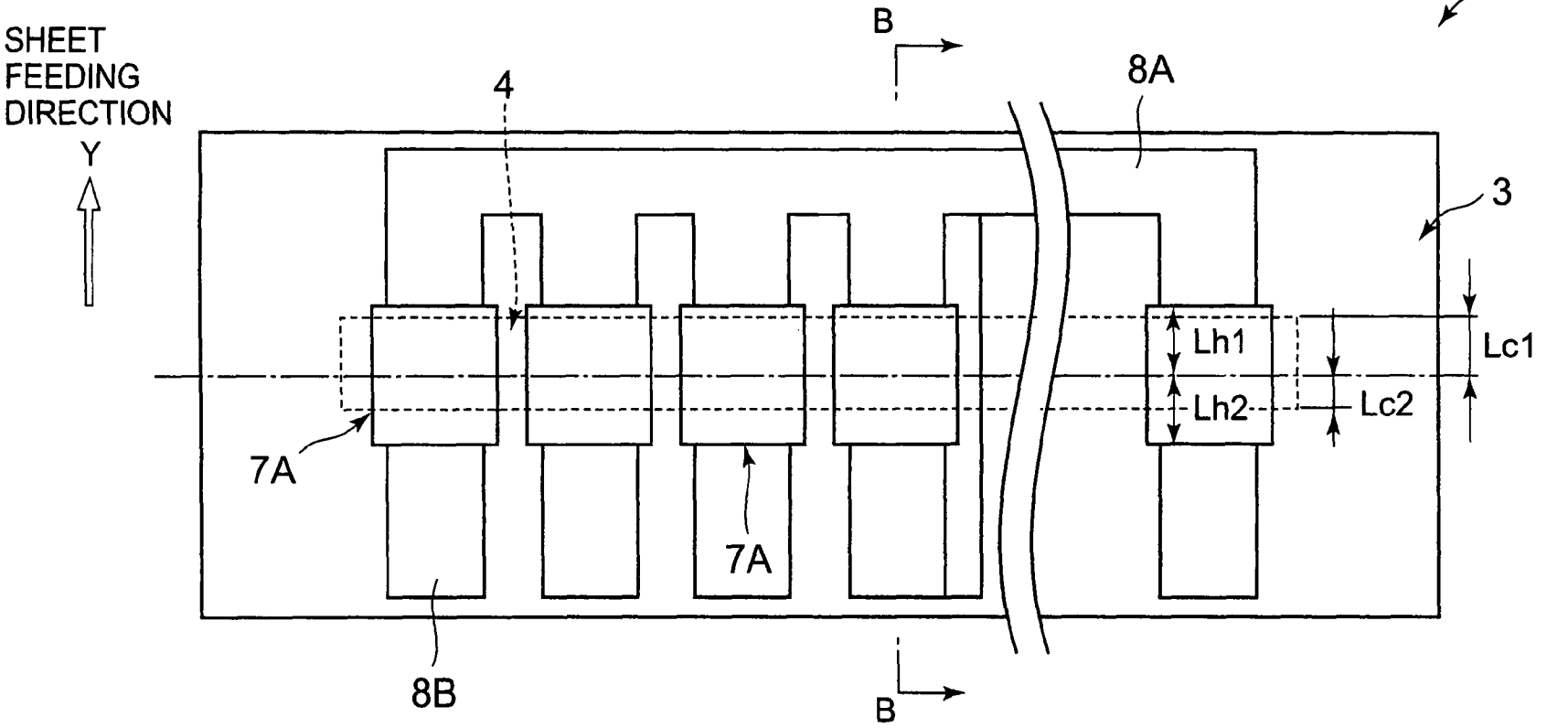
FIG. 10 is a plane view illustrating a thermal head according to a fourth modification of the embodiment of the present invention when seen from a protective film side.
Figure 11:
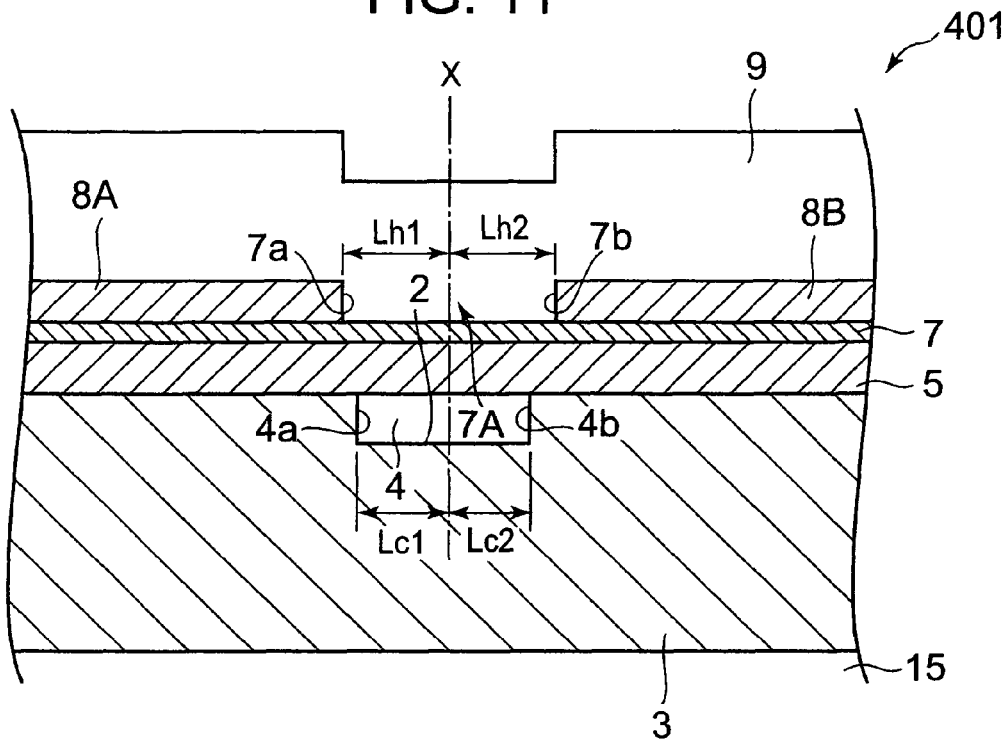
FIG. 11 is a sectional view taken along the arrows B-B of the thermal head of FIG. 10.

Further, in a thermal head 401 according to a fourth modification, as illustrated in FIGS. 10 and 11, the region of the hollow heat insulating layer 4 may be made smaller, when seen from the protective film 9 side, than the region of the heat generating portion 7A. Further, the hollow heat insulating layer 4 may be arranged within the region of the heat generating portion 7A, and the center line of the hollow heat insulating layer 4 may be arranged forward in the thermal paper feeding direction Y with respect to the center line X of the heat generating portion 7A. In this case, in the hollow heat insulating layer 4 and the heat generating portion 7A, relationships of Lc1>Lc2, Lc1<Lh1, and Lc2<Lh2 are established.

By this construction, in comparison with a case of making larger the region of the hollow heat insulating layer 4 than the region of the heat generating portion 7A, it is possible to improve the strength of the heat storage layer 5 against the external load from the platen roller 13.

Figure 12:
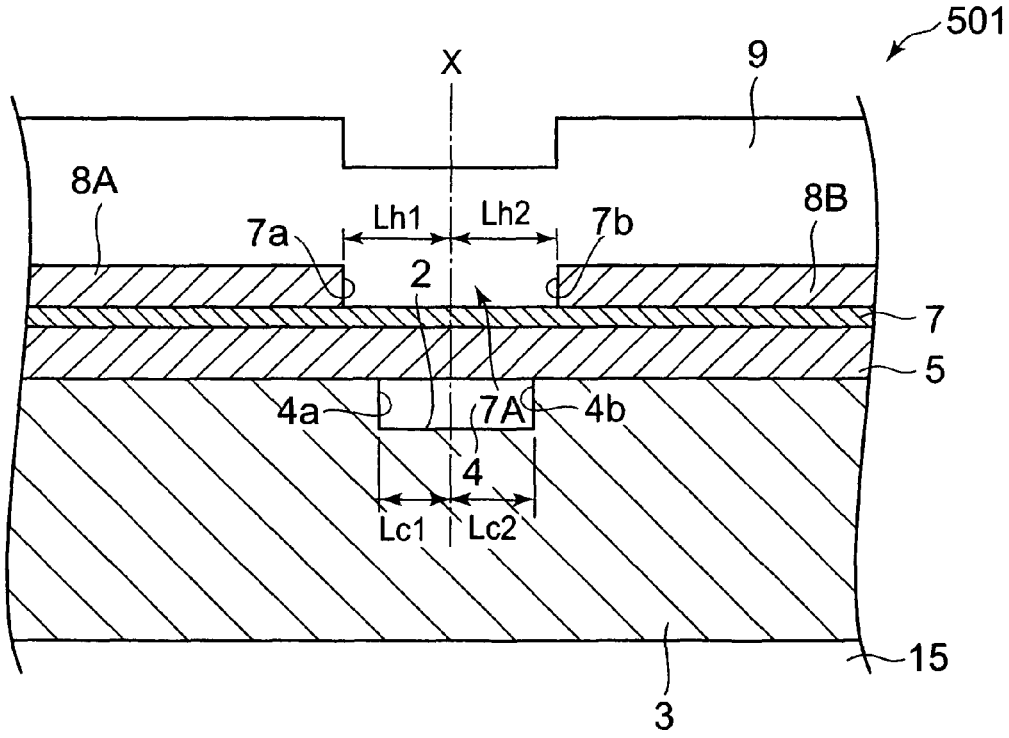
FIG. 12 is a vertical sectional view of a thermal head according to a fifth modification of the embodiment of the present invention.

Further, in a thermal head 501 according to a fifth modification, as illustrated in FIG. 12, when seen from the protective film 9 side, the region of the hollow heat insulating layer 4 may be smaller than the region of the heat generating portion 7A, the hollow heat insulating layer 4 may be arranged within the region of the heat generating portion 7A, and the center line of the hollow heat insulating layer 4 may be positioned rearward in the thermal paper feeding direction Y with respect to the center line X of the heat generating portion 7A. In this case, in the hollow heat insulating layer 4 and the heat generating portion 7A, relationships of Lc1<Lc2, Lc1<Lh1, and Lc2<Lh2 are established.

By the foregoing construction, in comparison with the case of making larger the region of the hollow heat insulating layer 4 than the region of the heat generating portion 7A, it is possible to improve the strength of the heat storage layer 5 against the load applied forward with respect to the center of the heat generating portion 7A.

As described above, while the embodiment of the present invention is described with reference to the drawings, the specific structure is not limited to the embodiment. The present invention also includes design modifications and the like without departing from the spirit of the present invention.

For example, in this embodiment, the concave portion 2 is formed on a surface on the heat storage layer 5 side of the supporting substrate 3. However, the concave portion 2 may be formed in a region, which is opposed to the heating resistor 7, of at least one of the surface of the supporting substrate 3 and the surface of the heat storage layer 5 on the supporting substrate 3 side.

What is claimed is:

1. A thermal head, comprising:

a substrate;

a heat storage layer bonded onto a surface of the substrate;

a heating resistor provided on the heat storage layer; and a pair of electrode portions connected to the heating resistor;

wherein a hollow portion is provided in a region of at least one of the surface of the substrate and a surface of the heat storage layer, the region in which the hollow portion is provided being opposed to the heating resistor, and a center line of the hollow portion being shifted with respect to a center line of a heating portion of the heating resistor which does not overlap with the pair of electrode portions.

2. A printer, comprising:

the thermal head according to claim 1; and a pressure mechanism for feeding out a paper medium on which printing is performed by the thermal head while the pressure mechanism presses the paper medium against the heating resistor of the thermal head.

3. A printer according to claim 2; wherein the center line of the hollow portion of the thermal head is positioned forward in a feeding direction of the paper medium with respect to the center line of the heating portion of the heating resistor; and wherein an end portion of the hollow portion positioned rearward in the feeding direction of the paper medium is arranged in a region opposed to the heating resistor.

4. A printer according to claim 2; wherein the center line of the hollow portion of the thermal head is positioned rearward in a feeding direction of the paper medium with respect to the center line of the heating portion of the heating resistor; and wherein an end portion of the hollow portion positioned forward in the feeding direction is arranged in a region opposed to the heating resistor.

5. A thermal head according to claim 1; wherein the heating portion of the heating resistor is disposed between connecting surfaces of the respective pair of electrode portions.

6. A thermal head according to claim 5; wherein the heating portion of the heating resistor is disposed substantially directly above the hollow portion.

7. A thermal head according to claim 1; wherein the heating portion of the heating resistor is disposed substantially directly above the hollow portion.

8. A thermal head according to claim 1; wherein the substrate has a concave portion that concaves up toward the heating portion of the heating resistor, and the heat storage layer covers the concave portion to form the hollow portion for inhibiting a heat inflow from the heat storage layer to the substrate.

9. A thermal head according to claim 8; wherein the heating portion of the heating resistor is disposed substantially directly above the hollow portion.

10. A printer comprising:

a thermal head according to claim 8; and a pressure mechanism for feeding out a paper medium on which printing is performed by the thermal head while the pressure mechanism presses the paper medium against the heating resistor of the thermal head.

11. A printer according to claim 10; wherein the center line of the hollow portion of the thermal head is positioned forward in a feeding direction of the paper medium with respect to the center line of the heating portion of the heating resistor; and wherein an end portion of the hollow portion positioned rearward in the feeding direction of the paper medium is arranged in a region opposed to the heating resistor.

12. A printer according to claim 10; wherein the center line of the hollow portion of the thermal head is positioned rearward in a feeding direction of the paper medium with respect to the center line of the heating portion of the heating resistor; and wherein an end portion of the hollow portion positioned forward in the feeding direction of the hollow portion is arranged in a region opposed to the heating resistor.

13. A printer according to claim 10; wherein the center line of the hollow portion of the thermal head is positioned rearward in a feeding direction of the paper medium with respect to the center line of the heating portion of the at least one heating resistor; and wherein an end portion of the hollow portion positioned forward in the feeding direction of the hollow portion is arranged in a region opposed to the at least one heating resistor.

14. A thermal head comprising:

a substrate having a recess formed therein;

a heat storage layer disposed on a surface of the substrate so as to cover the recess to form a hollow portion;

at least one heating resistor disposed on the heat storage layer and having a heating portion, a center line of the hollow portion being shifted with respect to a center line of the heating portion; and a pair of electrode portions connected to the at least one heating resistor so that the heating portion of the at least one heating resistor does not overlap the pair of electrode portions.

15. A thermal head according to claim 14; wherein the heating portion of the at least one heating resistor is disposed between connecting surfaces of the respective pair of electrode portions.

16. A thermal head according to claim 15; wherein the heating portion of the at least one heating resistor is disposed substantially directly above the hollow portion.

17. A thermal head according to claim 14; wherein the heating portion of the at least one heating resistor is disposed substantially directly above the hollow portion.

18. A thermal head according to claim 14; wherein the at least one heating resistor comprises a plurality of heating resistors each disposed on the heat storage layer and having a heating portion, a center line of the hollow portion being shifted with respect to a center line of each heating portion; and wherein the pair of electrode portions are connected to the plurality of heating resistors so that the heating portions do not overlap the pair of electrode portions.

19. A printer comprising:

a thermal head according to claim 14; and a pressure mechanism for feeding out a paper medium on which printing is performed by the thermal head while the pressure mechanism presses the paper medium against the heating resistor of the thermal head.

20. A printer according to claim 19; wherein the center line of the hollow portion of the thermal head is positioned forward in a feeding direction of the paper medium with respect to the center line of the heating portion of the at least one heating resistor; and wherein an end portion of the hollow portion positioned rearward in the feeding direction of the paper medium is arranged in a region opposed to the at least one heating resistor.

* * * * *